US011241731B2

(12) United States Patent
Sotozaki

(10) Patent No.: US 11,241,731 B2
(45) Date of Patent: Feb. 8, 2022

(54) HOT METAL SUPPLY INJECTION METHOD AND HOT METAL SUPPLY INJECTION DEVICE

(71) Applicant: TOYOTA JIDOSHA KABUSHIKI KAISHA, Toyota (JP)

(72) Inventor: Shuji Sotozaki, Okazaki (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/075,954

(22) Filed: Oct. 21, 2020

(65) Prior Publication Data

US 2021/0237148 A1 Aug. 5, 2021

(30) Foreign Application Priority Data

Feb. 5, 2020 (JP) ..... JP2020-018018

(51) Int. Cl.
*B22D 17/14* (2006.01)
*B22D 17/20* (2006.01)
*B22D 17/30* (2006.01)

(52) U.S. Cl.
CPC ..... *B22D 17/14* (2013.01); *B22D 17/203* (2013.01); *B22D 17/2023* (2013.01); *B22D 17/30* (2013.01)

(58) Field of Classification Search
CPC ..... B22D 17/14; B22D 17/145; B22D 17/20; B22D 17/30; B22D 17/2023; B22D 17/203; B22D 18/02; B22D 18/04; B22D 39/026; B22D 39/06
USPC ..... 164/113, 303, 305, 312
See application file for complete search history.

(56) References Cited

U.S. PATENT DOCUMENTS 6,230,786 B1 * 5/2001 Choshi ..... B22D 17/30 164/312

FOREIGN PATENT DOCUMENTS

JP 09-192811 A 7/1997
JP 2011-121060 A 6/2011

* cited by examiner

*Primary Examiner* — Kevin P Kerns
(74) *Attorney, Agent, or Firm* — Oblon, McClelland, Maier & Neustadt, L.L.P.

(57) ABSTRACT

A hot metal supply injection method includes generating a negative pressure in a cylindrical container by a negative pressure generation device, and causing molten metal to be sucked into the cylindrical container from a retention furnace, while keeping an opening portion of the cylindrical container immersed in the molten metal, arranging the opening portion of the cylindrical container in a gate of a cavity while holding the negative pressure by closing up the opening portion of the cylindrical container after moving an inner plunger tip to a tip side of the cylindrical container, and moving the inner plunger tip to a rear end side of the cylindrical container, then moving an outer plunger tip, together with the inner plunger tip, to the tip side of the cylindrical container, and filling the interior of the cavity with the molten metal through injection via the gate.

3 Claims, 9 Drawing Sheets

HOT METAL SUPPLY INJECTION METHOD AND HOT METAL SUPPLY INJECTION DEVICE

CROSS-REFERENCE TO RELATED APPLICATION

This application claims priority to Japanese Patent Application No. 2020-018018 filed on Feb. 5, 2020, incorporated herein by reference in its entirety.

BACKGROUND

1. Technical Field

The disclosure relates to a hot metal supply injection method and a hot metal supply injection device, and more specifically, to a hot metal supply injection method and a hot metal supply injection device for supplying and injecting molten metal.

2. Description of Related Art

In a hot metal supply injection method disclosed in Japanese Unexamined Patent Application Publication No. 09-192811 (JP 09-192811 A), semi-molten metal is supplied to a vertically erected injection sleeve. After that, the injection sleeve is put down horizontally and connected to a die-casting machine, and the semi-molten metal in the sleeve is pressed into a mold.

SUMMARY

The inventors of the disclosure of the present application have found the following problem. In this hot metal supply injection method, when the injection sleeve is put down horizontally, molten metal may spill out from an end portion of the injection sleeve. Therefore, it is difficult to handle low-viscosity molten metal.

In concrete terms, this hot metal supply injection method is premised on the utilization of molten metal with high solid-phase ratio. When low-viscosity molten metal or semi-molten metal with high liquid-phase ratio is laid horizontally, this semi-molten metal spills out from the injection sleeve. This hot metal supply injection method is designed to allow utilization of semi-molten metal with high liquid-phase ratio as well, but is considered not to be configured to enable such utilization technically.

The disclosure aims at restraining molten metal from spilling out.

A hot metal supply injection method according to the disclosure is designed to suck molten metal from a retention furnace and fill an interior of a cavity of a mold with the molten metal through injection, through the use of a cylindrical container, an annular outer plunger tip that is slidably arranged in the cylindrical container, an inner plunger tip that is slidably arranged inside the outer plunger tip, and a negative pressure generation device that generates a negative pressure in the cylindrical container. The hot metal supply injection method includes a step of generating a negative pressure in the cylindrical container by the negative pressure generation device, and causing the molten metal to be sucked into the cylindrical container from the retention furnace, while keeping an opening portion of a tip of the cylindrical container immersed in the molten metal, a step of arranging the opening portion of the cylindrical container in a gate of the cavity while holding the negative pressure by closing up the opening portion of the cylindrical container after moving the inner plunger tip to the tip side of the cylindrical container, and a step of moving the inner plunger tip to a rear end side of the cylindrical container, then moving the outer plunger tip, together with the inner plunger tip, to the tip side of the cylindrical container, and filling the interior of the cavity with the molten metal through injection via the gate.

According to this configuration, after being sucked up through the use of the negative pressure, the molten metal is retained in the cylindrical container while the negative pressure is held by closing up the opening portion of the cylindrical container by the inner plunger tip. Thus, the molten metal is unlikely to spill out regardless of the direction in which the cylindrical container is oriented. Besides, even when the inner plunger tip moves to the rear end side of the cylindrical container to release the negative pressure, the molten metal is unlikely to spill out, because the opening portion of the cylindrical container is arranged in the gate of the cavity. Then, the interior of the cavity can be filled with the molten metal through injection while the molten metal remains unlikely to spill out.

Besides, the step of filling though injection may include moving the inner plunger tip to the rear end side of the cylindrical container such that surfaces of the inner plunger tip and the outer plunger tip are shaped along an inner wall surface of the cylindrical container, then moving the outer plunger tip, together with the inner plunger tip, to the tip side of the cylindrical container, and filling the interior of the cavity with the molten metal through injection via the gate.

According to this configuration, the interior of the cavity can be filled, through injection, with substantially the entire molten metal retained in the cylindrical container, without leaving the molten metal in the cylindrical container.

A hot metal supply injection device according to the disclosure is designed to suck molten metal from a retention furnace and fill an interior of a cavity of a mold with the molten metal through injection. The hot metal supply injection device is equipped with a cylindrical container that has a tip equipped with an opening portion, and that can retain the molten metal inside, an annular outer plunger tip that is slidably arranged in the cylindrical container, an inner plunger tip that is slidably arranged inside the outer plunger tip, a moving device that moves the outer plunger tip and the inner plunger tip in a reciprocating manner independently of each other, and a negative pressure generation device that generates a negative pressure in the cylindrical container. The inner plunger tip holds the negative pressure by moving to the tip side of the cylindrical container and closing up the opening portion of the cylindrical container, after the negative pressure generation device generates the negative pressure in the cylindrical container to cause the molten metal to be sucked into the cylindrical container.

According to this configuration, after being sucked up, the molten metal is retained in the cylindrical container while the negative pressure is held by closing up the opening portion of the cylindrical container by the inner plunger tip. Thus, the molten metal is unlikely to spill out regardless of the direction in which the cylindrical container is oriented.

Besides, the outer plunger tip may fill the interior of the cavity of the mold with the molten metal through injection by moving, together with the inner plunger tip, to the tip side of the cylindrical container, when the opening portion of the cylindrical container is arranged in a gate of the cavity and the inner plunger tip moves to a rear end side of the cylindrical container.

According to this configuration, even when the inner plunger tip moves to the rear end side of the cylindrical container to release the negative pressure, the molten metal is unlikely to spill out, because the opening portion of the cylindrical container is arranged in the gate of the cavity. Then, the interior of the cavity can be filled with the molten metal through injection while the molten metal remains unlikely to spill out.

The disclosure can restrain molten metal from spilling out.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

One of the concrete embodiments to which the disclosure is applied will be described hereinafter in detail with reference to the drawings. It should be noted, however, that the disclosure should not be limited to the following embodiment. Besides, for the sake of clear explanation, the following description and drawings are appropriately simplified.

First Embodiment

Figure 1:
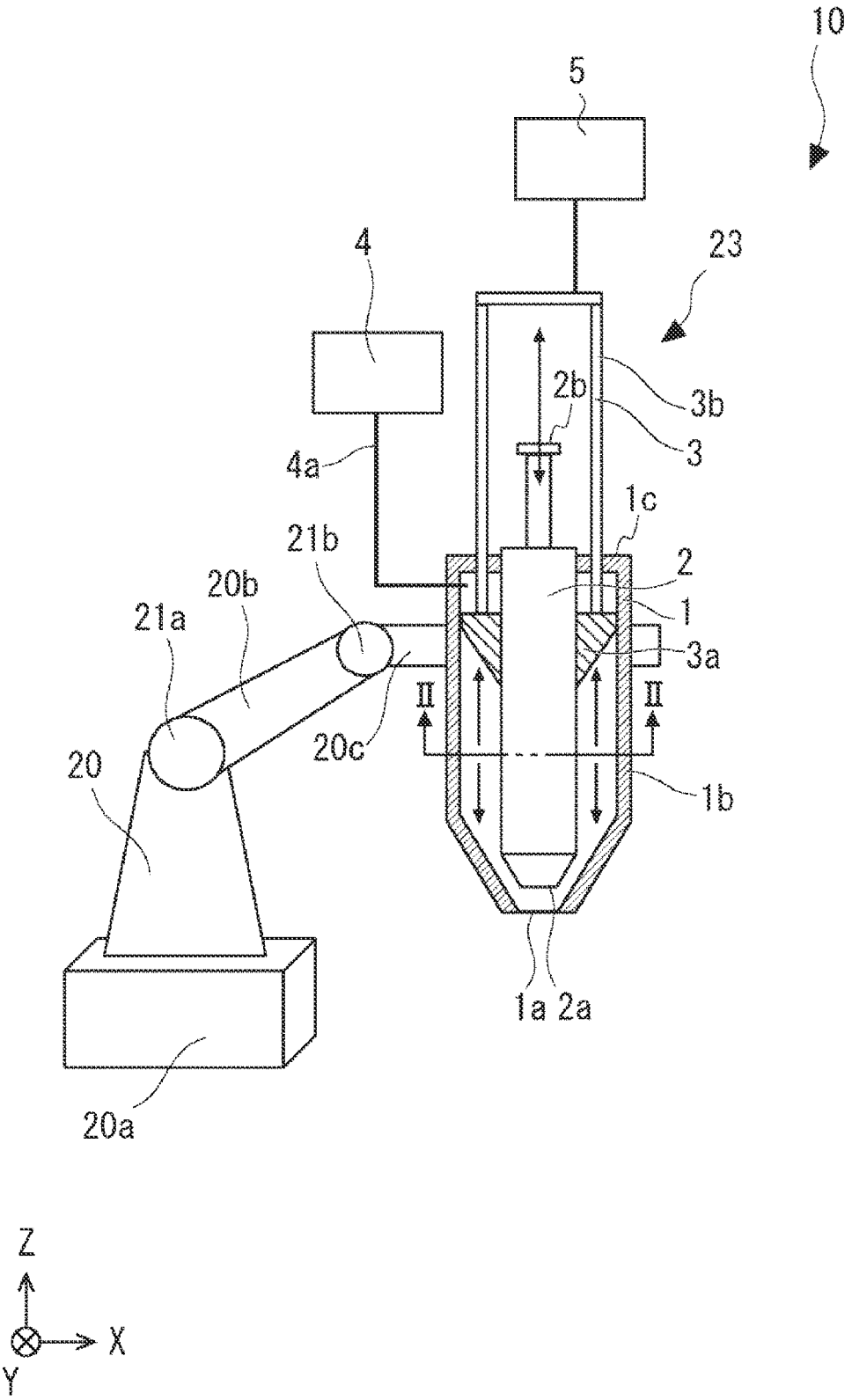
FIG. 1 is a schematic view showing a hot metal supply injection device that can be used in a hot metal supply injection method according to the first embodiment.
Figure 2:
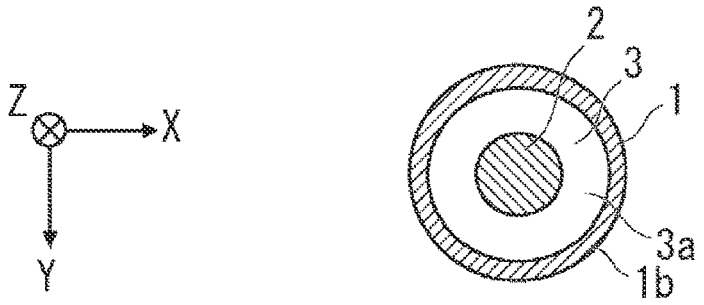
FIG. 2 is a cross-sectional view showing a cross-section of an essential part of the hot metal supply injection device that can be used in the hot metal supply injection method according to the first embodiment.
Figure 3:
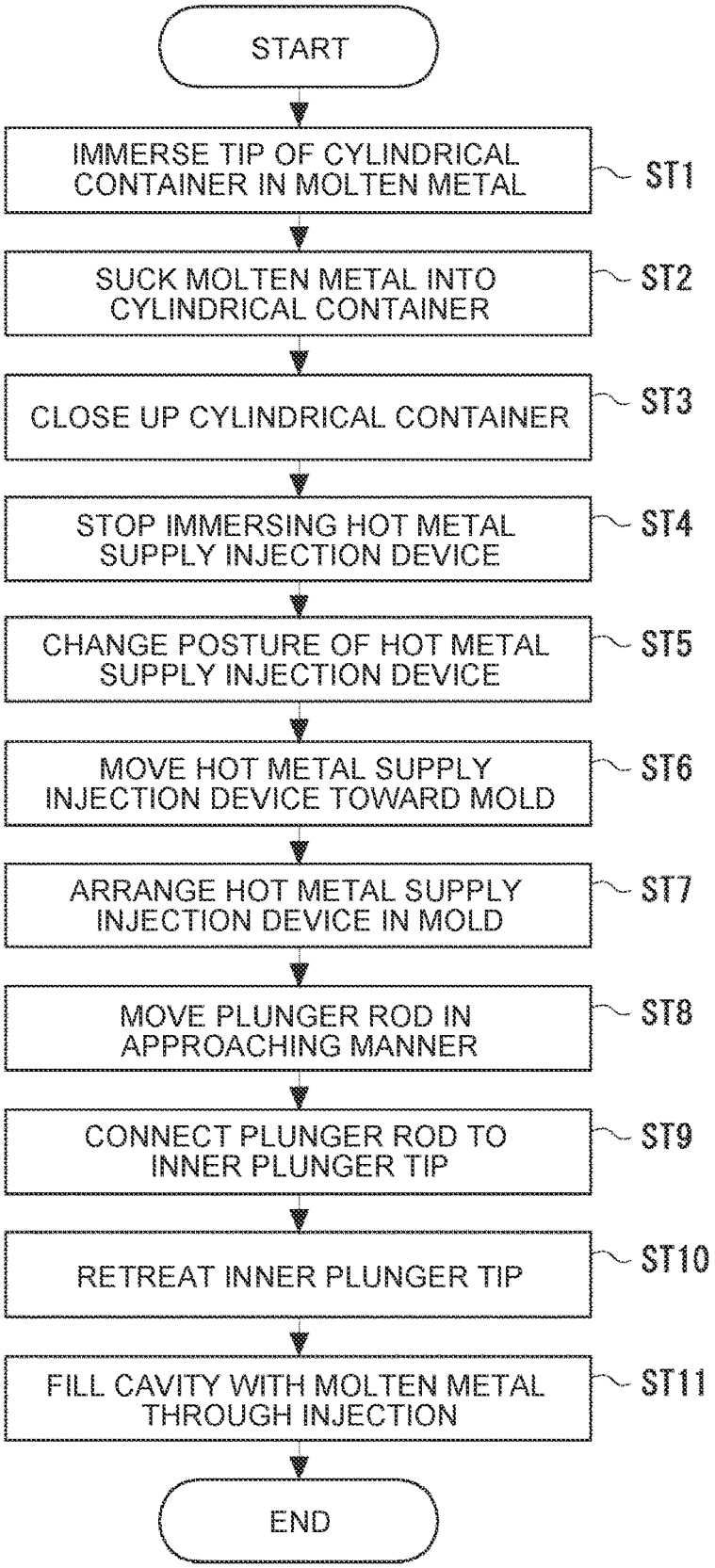
FIG. 3 is a flowchart showing the hot metal supply injection method according to the first embodiment.

A hot metal supply injection method according to the first embodiment will be described with reference to FIGS. 1 to 9. FIG. 1 is a schematic view showing a casting device that can be used in the hot metal supply injection method according to the first embodiment. FIG. 2 shows a cross-section of an essential part of the casting device shown in FIG. 1. FIG. 3 is a flowchart showing the hot metal supply injection method according to the first embodiment. FIGS. 4 to 8 are schematic views each showing a plurality of steps in the hot metal supply injection method according to the first embodiment. FIG. 9 is a schematic view showing one step in the hot metal supply injection method according to the first embodiment. Incidentally, for the sake of understandability, a negative pressure generation device 4, a moving device 5, a robot arm 20, and the like that will be described later are omitted in FIGS. 5 to 9.

Incidentally, as a matter of course, a right-hand XYZ coordinate system shown in each of FIG. 1 and other drawings is used for the sake of convenience to explain a positional relationship among components. In general, as is common among the drawings, the positive direction along a Z-axis represents a vertically upward direction, and an XY plane represents a horizontal plane.

In a hot metal supply injection method according to the first embodiment, a hot metal supply injection device 10 shown in FIG. 1 can be used. As shown in FIG. 1, the hot metal supply injection device 10 is equipped with a cylindrical container 1, a plunger tip 23, and the negative pressure generation device 4.

The cylindrical container 1 may be a container assuming the shape of a cylinder for retaining molten metal. For example, the cylindrical container 1 is made of, for example, a ceramic material. The cylindrical container 1 is equipped with, for example, a cylindrical portion 1*b* with a substantially circular cross-section shown in FIGS. 1 and 2. The cylindrical portion 1*b* is equipped with an opening portion 1*a* at a tip thereof, and with a rear end portion 1*c* at a rear end thereof. The opening portion 1*a* is formed at the tip of the cylindrical main body. The cross-section of the cylindrical portion 1*b* decreases in diameter toward the opening portion 1*a*.

The plunger tip 23 is slidably provided inside the cylindrical container 1. The plunger tip 23 is equipped with an inner plunger tip 2 and an outer plunger tip 3.

The outer plunger tip 3 is equipped with an outer plunger tip main body 3*a* and a rod 3*b*. The outer plunger tip main body 3*a* is an annular main body or a cylindrical main body. The rod 3*b* may be shaped in such a manner as to extend from the outer plunger tip main body 3*a* through the rear end portion 1*c* of the cylindrical container 1 and then through the rear end portion 1*c* of the cylindrical container 1 so as to return to the outer plunger tip main body 3*a*. The rod 3*b* extends substantially in the shape of C, U, V, or angulated U. Incidentally, the outer plunger tip 3 may be equipped with a cylindrical portion instead of the rod 3*b*.

The inner plunger tip 2 is a rod-like main body or a columnar main body. The inner plunger tip 2 is arranged inside the outer plunger tip 3. The inner plunger tip 2 is equipped with a tip portion 2*a* and a rear end portion 2*b*. When the tip portion 2*a* of the inner plunger tip 2 is pressed against the opening portion 1*a* of the cylindrical container 1, the inner plunger tip 2 assumes such a shape as to close up the opening portion 1*a*. Besides, an outer peripheral surface of the tip portion 2*a* of the inner plunger tip 2 may assume substantially the same shape as an inner wall surface of the opening portion 1*a* of the cylindrical container 1. The rear end portion 2*b* is equipped with a structure that can be removably and mechanically connected to a plunger rod or the like.

The negative pressure generation device 4 may be a device that generates a negative pressure in an inner space R1 of the cylindrical container 1. The negative pressure generation device 4 according to the present embodiment is a gas suction device that sucks gas. The gas is, for example, air or nitrogen gas. The negative pressure generation device 4 is connected to the inner space R1 of the cylindrical container 1 via a pipe 4*a* through which gas can flow. The pipe 4*a* according to the present embodiment is connected to the rear end portion 1*c* side of the inner space R1 of the cylindrical container 1. The negative pressure generation device 4 generates a negative pressure in the inner space R1 of the cylindrical container 1, by sucking the gas in the inner space R1 of the cylindrical container 1 via the pipe 4*a*. The pipe 4*a* may be provided with, for example, a changeover valve. The changeover valve may acquire a signal indicating a weight of the cylindrical container 1 from a weight sensor that measures the weight of the cylindrical container 1, and open or close the pipe 4*a* in accordance with the acquired signal.

The moving device 5 may be a device that moves the inner plunger tip 2 and the outer plunger tip 3 in a reciprocating manner independently of each other. The moving device 5 may be equipped with a drive system, for example, a servomotor. The moving device 5 may be, for example, an injection cylinder of a casting machine, a plunger rod, or a combination thereof.

Incidentally, the clearances among the cylindrical container 1, the inner plunger tip 2, and the outer plunger tip 3 may be set within a predetermined range. The clearances may be within the predetermined range such that the negative pressure generation device 4 can generate a negative pressure in the entirety of the inner space R1 of the cylindrical container 1 and suck molten metal. Furthermore, the clearances may be within the predetermined range such that the molten metal is not inserted between the cylindrical container 1 and the outer plunger tip 3 even when the molten metal is sucked into the inner space R1 due to the negative pressure generated by the negative pressure generation device 4. By the same token, the clearances may be within the predetermined range such that the molten metal is not inserted between the inner plunger tip 2 and the outer plunger tip 3 even when the molten metal is sucked into the inner space R1 due to the negative pressure generated by the negative pressure generation device 4.

Besides, the cylindrical container 1 can be freely moved in a translational manner within a predetermined three-dimensional space, and can be changed in posture so as to be oriented in a predetermined direction, by the robot arm 20. The robot arm 20 is equipped with, for example, a main body 20*a*, an arm 20*b*, and a hand 20*c*. The arm 20*b* is turnably connected to the main body 20*a* via a joint 21*a*. The hand 20*c* is turnably connected to the arm 20*b* via a joint 21*b*. The hand 20*c* grips the cylindrical container 1. The robot arm 20 can move the cylindrical container 1 in a translational manner and change the posture thereof as described above, through the turning of the hand 20*c* and the arm 20*b* while the hand 20*c* grips the cylindrical container 1.

Next, the hot metal supply injection method according to the first embodiment will be described with reference to FIG. 3. In the hot metal supply injection method according to the present embodiment, the hot metal supply injection device 10 is used.

Figure 4:
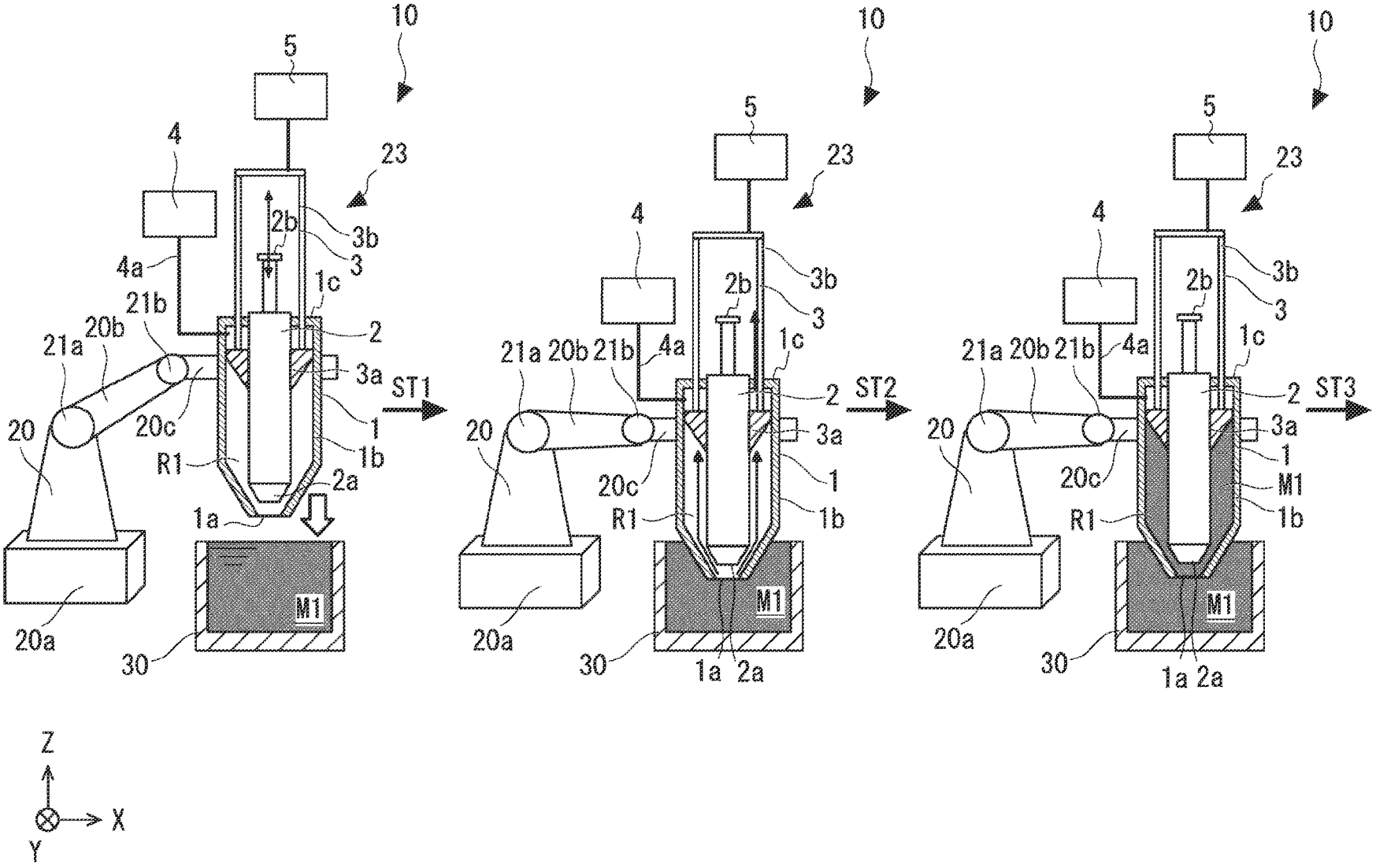
FIG. 4 is a schematic view showing a plurality of steps in the hot metal supply injection method according to the first embodiment.

As shown in FIG. 4, the tip of the cylindrical container 1 is immersed in molten metal M1 with the opening portion 1*a* at the tip of the cylindrical container 1 open (in a cylindrical container immersion step ST1). The molten metal M1 is retained in a heated state in a retention furnace 30. The molten metal M1 is obtained by melting a metal material, and this metal material is, for example, aluminum or aluminum alloy. The molten metal M1 may be, for example, semi-molten metal or semi-solidified metal. The semi-molten metal is obtained by, for example, retaining a solid metal in a heated state at a predetermined temperature within a solid-liquid coexistence temperature range. The semi-solidified metal may be obtained by, for example, cooling a liquid metal to a predetermined temperature within the solid-liquid coexistence temperature range.

Subsequently, a negative pressure is generated in the cylindrical container 1 by the negative pressure generation device 4, and the molten metal M1 is sucked into the cylindrical container 1 from the retention furnace 30 (in a molten metal suction step ST2). In concrete terms, the negative pressure generation device 4 sucks the gas in the cylindrical container 1 to generate a negative pressure in the cylindrical container 1. Due to this negative pressure, the molten metal M1 is sucked into the inner space R1 from the retention furnace 30. The inner space R1 is filled with the molten metal M1.

Figure 5:
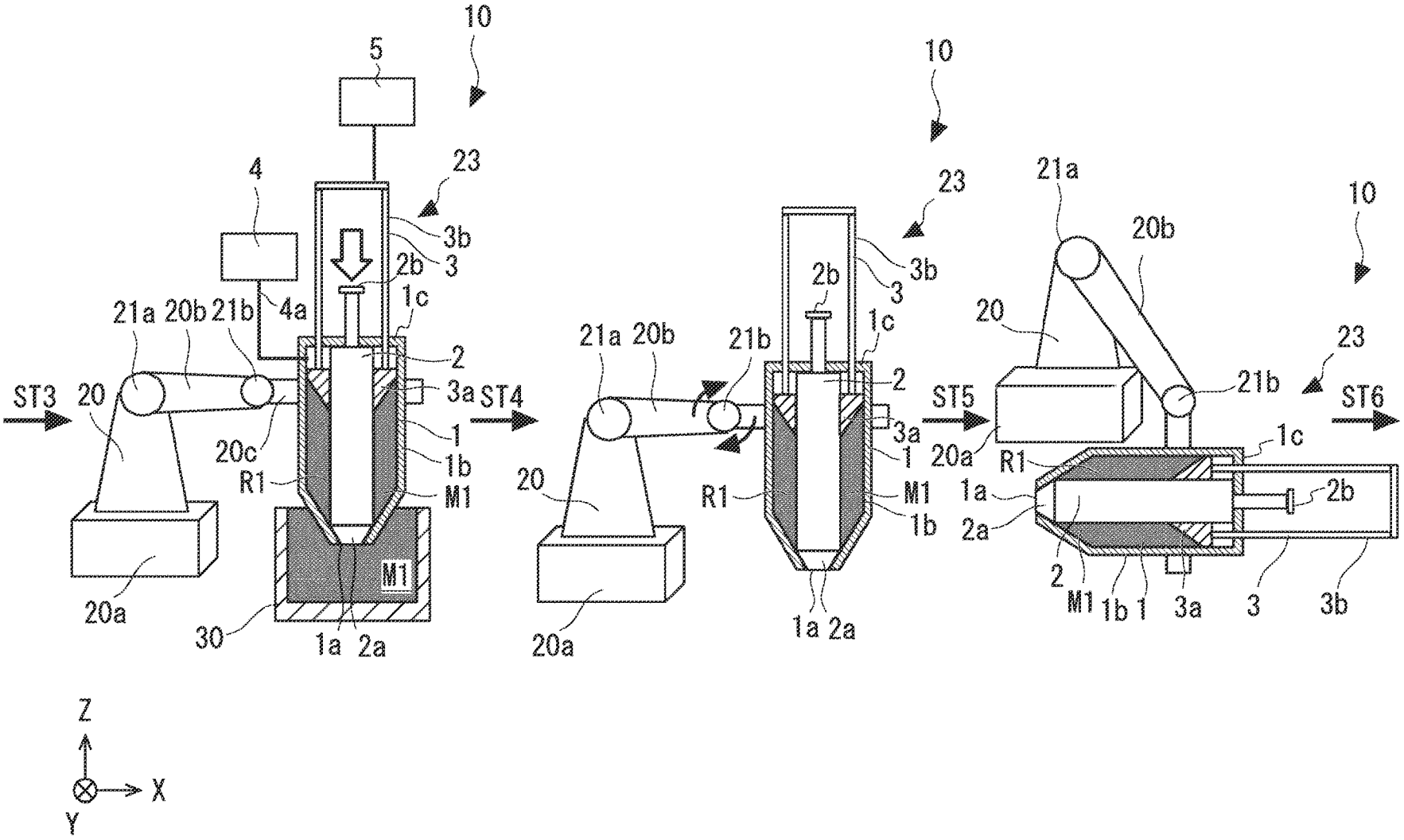
FIG. 5 is a schematic view showing a plurality of steps in the hot metal supply injection method according to the first embodiment.

Subsequently, as shown in FIG. 5, the inner plunger tip 2 is moved further toward the tip side of the cylindrical container 1 than the tip of the outer plunger tip main body 3*a* of the outer plunger tip 3 and the opening portion 1*a* of the tip of the cylindrical container 1 is closed up (in a cylindrical container close-up step ST3). By closing up the opening portion 1*a*, the negative pressure in the inner space R1 is held. The negative pressure in the inner space R1 may be held by appropriately closing up the pipe 4*a* through the use of the changeover valve or the like. The negative pressure in the inner space R1 may be held from the cylindrical container close-up step ST3 to a plunger rod connection step ST9 (which will be described later). In the case where the liquid surface of the molten metal M1 is close to or in contact with the tip of the outer plunger tip main body 3*a* of the outer plunger tip 3, the sleeve filling rate of the molten metal M1 can be enhanced in an advantageous manner.

Subsequently, the hot metal supply injection device 10 is moved and taken out from the retention furnace 30 to stop immersion, by the robot arm 20 (in a hot metal supply injection device immersion stop step ST4). Subsequently, the hot metal supply injection device 10 is changed in posture so as to be oriented in the predetermined direction by the robot arm 20 (in a hot metal supply injection device posture change step ST5). The hot metal supply injection device 10 may be oriented in a direction toward a gate G1 of a cavity C1 of a mold 40 shown in FIG. 6.

Figure 6:
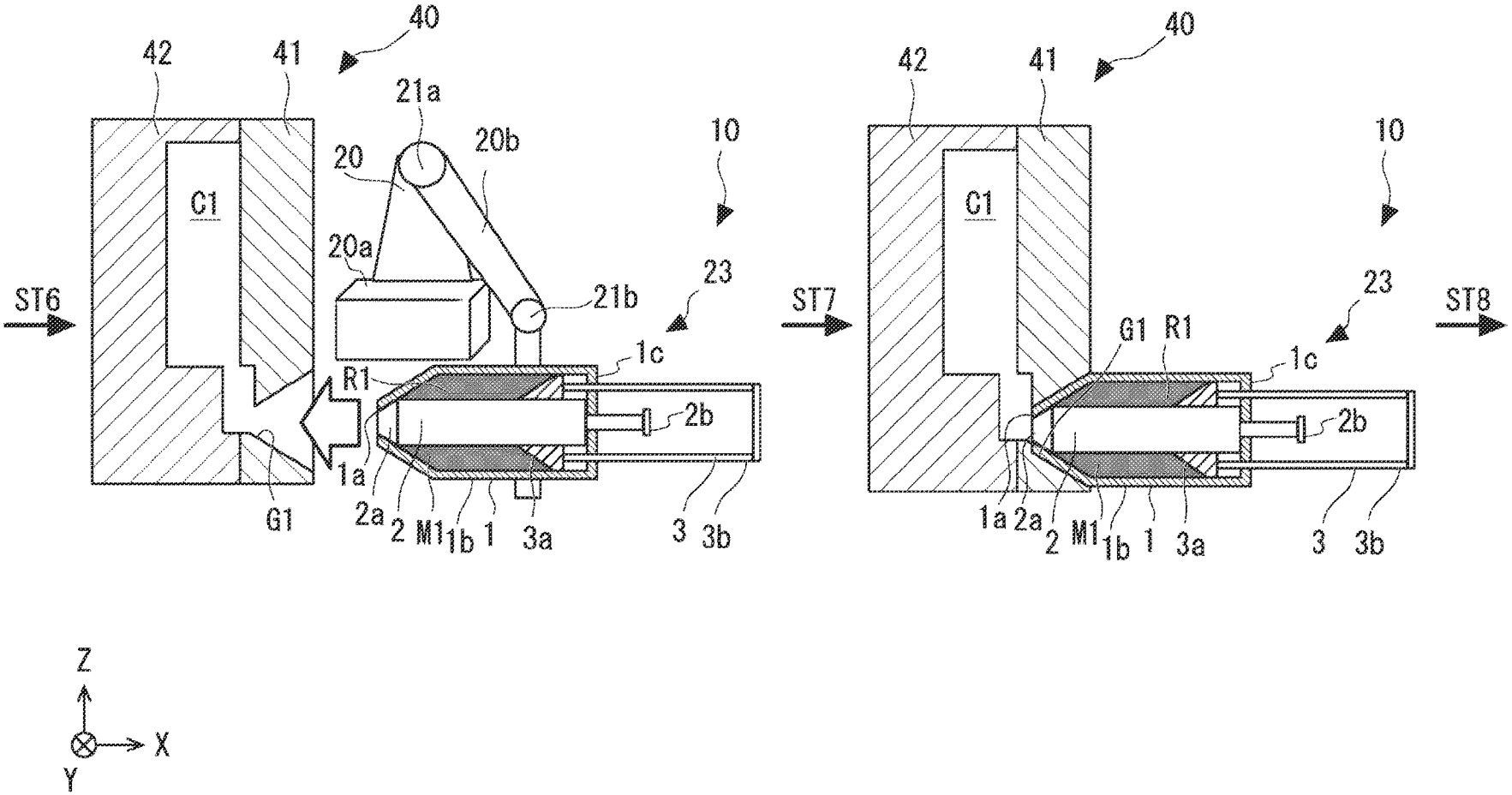
FIG. 6 is a schematic view showing a plurality of steps in the hot metal supply injection method according to the first embodiment.

Subsequently, as shown in FIG. 6, the hot metal supply injection device 10 is moved close to the mold 40 by the robot arm 20 (in a hot metal supply injection device moving step ST6). Subsequently, the opening portion 1*a* of the cylindrical container 1 is arranged in the gate G1 of the cavity C1 of the mold 40 (in a hot metal supply injection device arrangement step ST7). The opening portion 1*a* of the cylindrical container 1 is in contact with the gate G1 of the cavity C1 of the mold 40.

Figure 7:
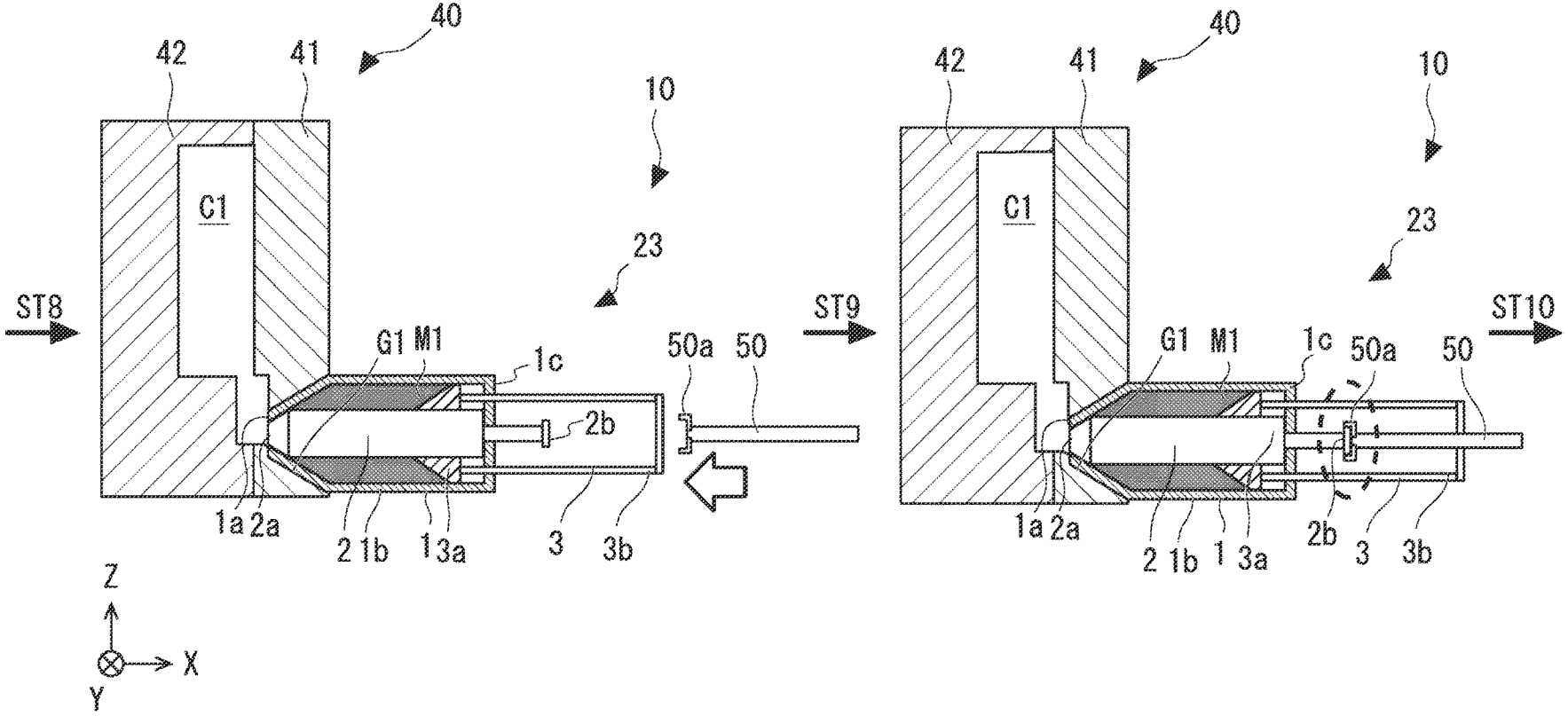
FIG. 7 is a schematic view showing a plurality of steps in the hot metal supply injection method according to the first embodiment.

Subsequently, as shown in FIG. 7, a plunger rod 50 is moved close to the inner plunger tip 2 (in a plunger rod moving step ST8), and a tip portion 50*a* of the plunger rod 50 and the rear end portion 2*b* of the inner plunger tip 2 are mechanically connected to each other (in a plunger rod connection step ST9). The tip portion 50*a* may be configured to grip or be fitted to the rear end portion 2*b* upon receiving a reactive force from the rear end portion 2*b* by being pressed against the rear end portion 2*b*. The tip portion 50*a* may assume, for example, a shape other than the shape of a circle around an axis of the plunger rod 50, more specifically, a shape extending in a minus manner, a tongue-like shape, or a rod-like shape, on a plane perpendicular to the axis of the plunger rod 50 (a YZ plane in this case).

Figure 8:
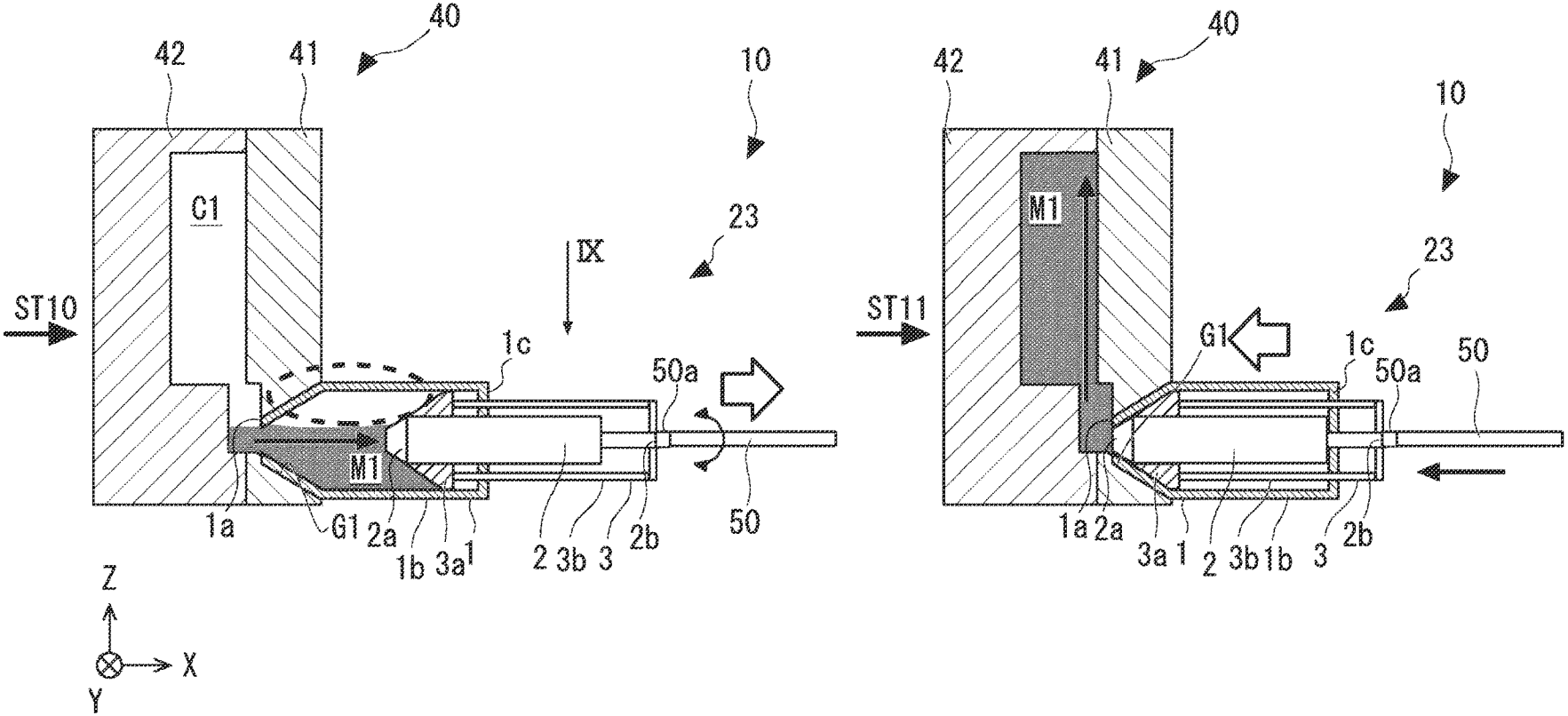
FIG. 8 is a schematic view showing a plurality of steps in the hot metal supply injection method according to the first embodiment.
Figure 9:
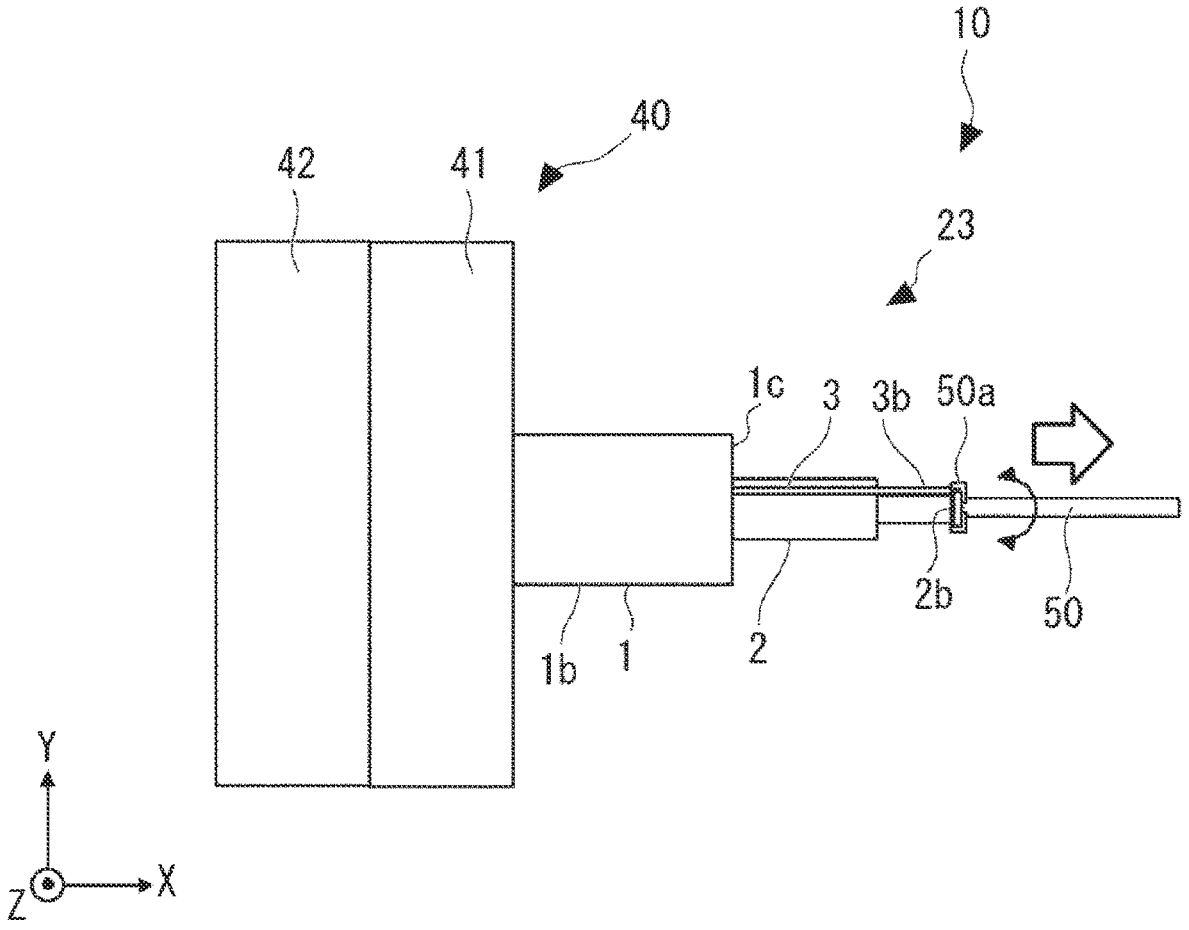
FIG. 9 is a schematic view showing one step in the hot metal supply injection method according to the first embodiment.

Subsequently, as shown in FIG. 8, the tip portion 2*a* of the inner plunger tip 2 is shifted to the rear end portion 1*c* side of the cylindrical container 1, and is mechanically connected to the outer plunger tip 3 (in an inner plunger tip retreat step ST10). In concrete terms, the inner plunger tip 2 may be retreated such that the surfaces of the inner plunger tip 2 and the outer plunger tip 3 are shaped along the inner wall surface of the cylindrical container 1. Alternatively, the inner plunger tip 2 may be retreated until the tip portion 2*a* of the inner plunger tip 2 is located at the same position as the tip of the outer plunger tip main body 3*a* of the outer plunger tip 3 in an axial direction of the cylindrical container 1 (an X-axis direction in this case). Incidentally, when the inner plunger tip 2 is retreated, the opening portion 1*a* of the cylindrical container 1 and the gate G1 of the cavity C1 of the mold 40 are connected to each other such that the molten metal M1 can flow therethrough. After retreating the inner plunger tip 2, the plunger rod 50 and the outer plunger tip 3 are mechanically connected to each other, by superimposing the tip portion 50*a* and the rod 3*b* on each other on the plane perpendicular to the axis of the plunger rod 50 (the YZ plane in this case) through, for example, rotation of the axis of the plunger rod 50, as shown in FIGS. 8 and 9.

Subsequently, the outer plunger tip 3 is moved, together with the inner plunger tip 2, to the gate G1 side, and the interior of the cavity C1 is filled with the molten metal M1 through injection via the gate G1 (in an injection filling step ST11). In the case where the surfaces of the inner plunger tip 2 and the outer plunger tip 3 are shaped along the inner wall surface of the cylindrical container 1, the interior of the cavity C1 may be filled with the entire molten metal M1 through injection. After filling the cavity C1 with the molten metal M1 through injection, a cast product can be formed by solidifying the molten metal M1. A predetermined pressure may be appropriately transmitted to the molten metal M1 while solidifying the molten metal M1. After that, a movable die 42 is separated from a fixed die 41 of the mold 40, so the cast product can be removed from the fixed die 41 and obtained.

Owing to the foregoing, with the aforementioned hot metal supply injection method according to the first embodiment, after the molten metal M1 is sucked into the inner space R1 of the cylindrical container 1, the opening portion 1*a* of the cylindrical container 1 is closed up to retain the molten metal M1 in the inner space R1 of the cylindrical container 1. Therefore, regardless of the direction in which the cylindrical container 1 is oriented, the molten metal M1 remains in the inner space R1 of the cylindrical container 1, and hence is unlikely to spill out. Thus, the sleeve filling rate is restrained from falling, and the temperature of the molten metal is restrained from falling. Therefore, the quality of the cast product such as a die-cast product is restrained from deteriorating.

Besides, even when the inner plunger tip 2 moves to the rear end portion 1*c* side of the cylindrical container 1 to release the negative pressure, the molten metal M1 is unlikely to spill out, because the opening portion 1*a* of the cylindrical container 1 is arranged in the gate G1 of the cavity C1. That is, the molten metal M1 can be restrained from spilling out.

Besides, the tip of the cylindrical container 1 is immersed in the liquid of the molten metal M1 to suck the molten metal M1. Therefore, the surface area of the molten metal that is in contact with the gas such as air is small. In consequence, the molten metal M1 is unlikely to be oxidized, so the quality of the molten metal can be held high. In consequence, even when the casting pressure is low, cast products with the same high quality can be manufactured. That is, even when the hot metal supply injection device 10 is applied to a casting machine with low casting pressure, cast products with good quality can be manufactured in a favorable manner.

Besides, with the foregoing hot metal supply injection method according to the first embodiment, the molten metal M1 is sucked from the retention furnace 30, and the interior of the cavity C1 of the mold 40 is filled with the molten metal M1 through injection, so there is no need for a sleeve or ladle. Accordingly, the number of component parts of a casting machine such as a die-casting machine can be reduced.

Incidentally, the disclosure is not limited to the foregoing embodiment, but can be appropriately changed within such a range as not to depart from the gist thereof. Besides, the disclosure may be carried out by appropriately combining the foregoing embodiment and an example thereof.

What is claimed is:

1. A hot metal supply injection method for sucking molten metal from a retention furnace and filling an interior of a cavity of a mold with the molten metal through injection, through use of a cylindrical container, an annular outer plunger tip that is slidably arranged in the cylindrical container, an inner plunger tip that is slidably arranged inside the outer plunger tip, and a negative pressure generation device that generates a negative pressure in the cylindrical container, the hot metal supply injection method comprising:

a step of generating a negative pressure in the cylindrical container by the negative pressure generation device, and causing the molten metal to be sucked into the cylindrical container from the retention furnace, while keeping an opening portion of a tip of the cylindrical container immersed in the molten metal;

a step of arranging the opening portion of the cylindrical container in a gate of the cavity while holding the negative pressure by closing up the opening portion of the cylindrical container after moving the inner plunger tip to a tip side of the cylindrical container; and a step of moving the inner plunger tip to a rear end side of the cylindrical container, then moving the outer plunger tip, together with the inner plunger tip, to the tip side of the cylindrical container, and filling the interior of the cavity with the molten metal through injection via the gate.

2. The hot metal supply injection method according to claim 1, wherein the step of filling though injection includes moving the inner plunger tip to the rear end side of the cylindrical container such that surfaces of the inner plunger tip and the outer plunger tip are shaped along an inner wall surface of the cylindrical container, then moving the outer plunger tip, together with the inner plunger tip, to the tip side of the cylindrical container, and filling the interior of the cavity with the molten metal through injection via the gate.

3. The hot metal supply injection method according to claim 1, wherein the annular outer plunger tip and the inner plunger tip are both shaped to a tapered portion of an inner wall surface at a tip side of the cylindrical container.

* * * * *